United States Patent [19]

Hwang

[11] 4,325,425

[45] Apr. 20, 1982

[54] METHOD FOR LIMITING HEAT FLUX IN DOUBLE-WALL TUBES

[75] Inventor: Jaw-Yeu Hwang, Tampa, Fla.

[73] Assignee: The United States of America as represented by the United States Department of Energy, Washington, D.C.

[21] Appl. No.: 172,599

[22] Filed: Jul. 28, 1980

[51] Int. Cl.[3] ..... F28F 27/00

[52] U.S. Cl. ..... 165/1; 165/32

[58] Field of Search ..... 165/1, 32, 96, 154

[56] References Cited

U.S. PATENT DOCUMENTS

| | | | |
|---|---|---|---|
| 3,270,802 | 9/1966 | Lindberg | 165/96 X |
| 4,161,212 | 7/1979 | Hightower | 165/96 |
| 4,224,980 | 9/1980 | Buchner | 165/32 |

*Primary Examiner*—Albert W. Davis
*Assistant Examiner*—Margaret A. Focarino
*Attorney, Agent, or Firm*—F. J. Baehr, Jr.

[57] ABSTRACT

A method of limiting the heat flux in a portion of double-wall tubes including heat treating the tubes so that the walls separate when subjected to high heat flux and supplying an inert gas mixture to the gap at the interface of the double-wall tubes.

4 Claims, 1 Drawing Figure

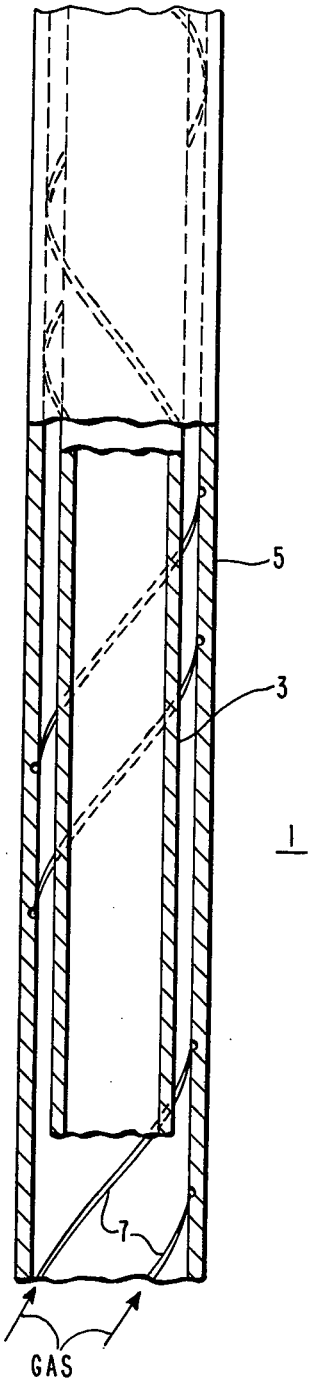
5
3
1
7
GAS

METHOD FOR LIMITING HEAT FLUX IN DOUBLE-WALL TUBES

BACKGROUND OF THE INVENTION

This invention relates to heat-exchanger tubes and more particularly to a method of limiting the heat flux across heat-exchanger tubes.

While it is generally desirable to maximize the thermal conductance of heat-exchanger tubes, in recirculating steam generators in which a liquid metal is utilized as the primary fluid, it is desirable to limit the heat flux to avoid DNB (Departure from Nucleate Boiling) and/or to inhibit certain corrosion mechanisms, which are strongly dependent on heat flux. Alternate methods, which include protective sleeves on the tubes, produce similar results, but require special design features and are more costly.

SUMMARY OF THE INVENTION

In general, a method of limiting the heat flux in portions of a double wall tube having inner and outer walls, when performed in accordance with this invention, comprise the steps of heat treating the tube so that the outer wall separates from the inner wall as the differential temperature across the tube reaches a predetermined level, supplying a mixture of gases between the tube walls, whereby the greater the differential temperature the greater the separation between the tube walls and the greater the thermal resistance of the tubes and gas mixture.

BRIEF DESCRIPTION OF THE DRAWINGS

The objects and advantages of this invention will become more apparent from reading the following detailed description in conjunction with the accompanying drawing in which the sole FIGURE is a partial sectional view of a double-wall heat exchanger to having a mixture of gases supplied between the inner and outer wall.

DESCRIPTION OF THE PREFERRED EMBODIMENT

The method of limiting the heat flux in portions of double-wall tubes 1 having inner and outer walls 3 and 5 comprises the steps of heat treating or annealing the tubes so that the outer wall 5 separates from the inner wall 3 as the differential temperature reaches a predetermined level depending upon the magnitude of fluid pressure differential from the tube bore to the outside surface; providing longitudinal grooves 7 at the interface of the inner and outer walls 3 and 5 of the tubes 1, the grooves may spiral as they progress from one end to the tube 1 to the other; supplying a mixture of gases to the grooves 7 and interface gap formed as the walls 3 and 5 separate the mixture being designed to provide the desired conductivity across the tube walls 3 and 5 and interface gap. A mixture of 65% helium and 35% argon has been found to maintain the heat flux under 200,000 btu's per hour per square foot of surface in liquid sodium and water in a counterflow steam generator design.

The method hereinbefore described has the advantage that the greater the differential temperature the greater the separation between the tube walls 3 and 5 and the greater the thermal resistance of the tubes 1 and gas mixture. In addition to providing limiting heat flux in the region subjected to maximum heat flux, this method provides the major advantage of not inducing thermal ineffectiveness in other regions of the tube 1 operating at lower heat fluxes or low temperature differential since the walls 3 and 5 of the tubes do not separate sufficiently in these regions to drastically reduce the conductance of the tubes 1.

What is claimed is:

1. A method of limiting the heat flux in a portion of a double-wall tube having an inner and outer wall, said method comprising the steps of:

heat treating the tube so that the outer wall separates from the inner wall as a differential temperature across the tube reaches a predetermined level; and supplying a mixture of gases between the tube walls;

whereby the greater the differential temperature the greater the separation between the tube walls and the greater the thermal resistance of the tube and gas mixture.

2. A method as set forth in claim 1 and further comprising the step of providing at least one longitudinal groove in the tube at the interface of the inner and outer walls in order to supply the gas mixture along the length of the tube.

3. The method as set forth in claim 1, wherein the step of supplying a mixture of gases comprises supplying a mixture of helium and argon.

4. The method as set forth in claim 1 wherein the step of supplying a mixture of gases comprises supplying a mixture of approximately 65% helium and 35% argon.

* * * * *